US010314759B1

(12) United States Patent
Ramage

(10) Patent No.: US 10,314,759 B1
(45) Date of Patent: Jun. 11, 2019

(54) GRIP AND FOREARM ENHANCER DEVICE AND METHOD

(71) Applicant: 4ArmStrong, LLC, Mission Viejo, CA (US)

(72) Inventor: Lee Ramage, Encinitas, CA (US)

(73) Assignee: 4ArmStrong, LLC, Carlsbad, CA (US)

( * ) Notice: Subject to any disclaimer, the term of this patent is extended or adjusted under 35 U.S.C. 154(b) by 673 days.

(21) Appl. No.: 14/954,896

(22) Filed: Nov. 30, 2015

Related U.S. Application Data

(60) Provisional application No. 62/102,253, filed on Jan. 12, 2015.

(51) Int. Cl.

| | |
|---|---|
| ***A61H 1/02*** | (2006.01) |
| ***A63B 23/12*** | (2006.01) |
| ***A63B 23/16*** | (2006.01) |
| *A63B 23/00* | (2006.01) |

(52) U.S. Cl.
CPC ..... *A61H 1/0274* (2013.01); *A63B 23/12* (2013.01); *A63B 23/16* (2013.01); *A61H 2205/06* (2013.01); *A63B 2023/006* (2013.01)

(58) Field of Classification Search
CPC ..... A61H 1/0274; A63B 23/12; A63B 23/16; A63B 2023/006
See application file for complete search history.

(56) References Cited

U.S. PATENT DOCUMENTS

| | | | | |
|---|---|---|---|---|
| 5,441,058 | A * | 8/1995 | Fareed | A61F 5/0118 128/878 |
| 5,501,657 | A | 3/1996 | Feero | |
| 5,512,056 | A * | 4/1996 | Stevens | A61B 17/1325 606/203 |
| 5,730,708 | A * | 3/1998 | Spratt | A61H 7/003 601/118 |
| 6,155,994 | A | 12/2000 | Hubbard et al. | |
| 6,821,288 | B2 | 11/2004 | Schaeffer | |
| 6,979,305 | B2 * | 12/2005 | Porrata | A61F 5/0118 128/879 |
| 8,357,109 | B2 * | 1/2013 | DeStefano | A61H 7/001 601/134 |
| 8,821,420 | B1 | 9/2014 | Callahan | |
| 2010/0130901 | A1 * | 5/2010 | Franke | A61F 5/0111 602/23 |
| 2013/0289614 | A1 * | 10/2013 | Cully | A61B 17/1322 606/203 |
| 2014/0188024 | A1 * | 7/2014 | Cox | A61F 5/01 602/20 |

* cited by examiner

*Primary Examiner* — Timothy A Stanis
(74) *Attorney, Agent, or Firm* — Clause Eight IPS; Michael Catania

(57) ABSTRACT

A device for enhancing grip strength and forearm health of a user is disclosed herein. The device comprises a body in the form of a strap, a cuff disposed within a portion of the body, a tensioner comprising a rounded contact point and a threaded bolt. The device of the present invention allows a user to stretch and expand the fascia, allowing for blood to be increased in these muscles with less restriction.

1 Claim, 18 Drawing Sheets

GRIP AND FOREARM ENHANCER DEVICE AND METHOD

CROSS REFERENCE TO RELATED APPLICATION

The Present Application claims priority to U.S. Patent Application No. 62/102,253, filed on Jan. 12, 2015, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention generally relates to devices for enhancing the grip strength of a user.

Description of the Related Art

The prior art discusses various ailments by athletes related to overuse of a forearm.

MotoGP racers are prone to a particular type of injury more common in runners than motorcycle riders: arm pump. Of course, runners experience this condition in their legs, the medical term for which is chronic exertional compartment syndrome (CECS). In the paddock, however, CECS is simply called arm pump. CECS is a type of overuse sports injury that affects men and women equally. Most reported cases are among endurance athletes in running sports. On two wheels, arm pump seems to be more prevalent in motocross than road racing.

Muscles are bundled in a strong, thin, not very stretchy membrane called fascia—like casing on a sausage. Muscle use raises energy demand. An increase in energy demand is met by increased blood flow. increased blood flow can cause a growth in muscle volume by as much as 20 percent, but because the fascia doesn't expand, things get tight in the compartment. When things get tight, it's harder for energy to get where it needs to go, so the entire limb starts underperforming. An underperforming forearm means an underperforming wrist, hand, and fingers.

According to the latest research, the only definitive treatment for arm pump is a fasciotomy: a surgical procedure performed under general anesthesia in which the surgeon cuts a slit in the fascia to release the pressure within the affected compartment.

Climbers also are prone to forearm pump. The pump sensation in the forearms is largely the result of accumulated lactic acid and restricted blood flow. While the dangling-arm shakeout allows good blood flow into the forearm, it doesn't help the flow of "old blood" out of the forearm, due to the arm's position below your heart. The result perpetuates the pump and slows recovery.

A flexor-pronator strain of the elbow is a common source of pain in the elbows of pitchers. The pain is located on the medial side of the elbow. The flexo-pronator muscle are a source of medial elbow pain in throwing athletes such as pitchers in baseball. The are many causes of pain such as medial epicondylitis (tennis elbow) ulnar neuritis, and ulnar collateral ligament injury (Tommy John injury). A flexor-pronator strain can either result from an acute event or can develop as a result of overuse. A pitcher who has an acute flexor-pronator strain will remember a specific throw where he felt sharp pain on the medial side of the elbow. His pain will usually be located just past the bony prominence on the inside of the elbow. He often will have pain flexing the wrist or pronating the forearm.

Evaluation by a sports medicine physician is important soon after the injury to try to determine the correct diagnosis quickly. X-rays are usually normal with this injury. Most of the time, a flexor-pronator strain is treated with rest from pitching for several weeks to give die tendons time to heal. Ice and physical therapy can also be helpful to decrease the athlete's symptoms. As the pain improves, the pitcher will be started on a long toss program prior to returning to full pitching.

Flexor bundle injuries refer to muscle strain and tendon injuries (tendinitis or tear) of the common wrist flexor muscles and tendon attachment to the medial epicondyle (inner part of the elbow). Pain is localized to the inner (medial) part of the elbow, but is more noticeable at ball release rather than at the cocking or acceleration phases of throwing. This usually responds very well to rest and rehabilitation, A PRP injection may also aid in healing flexor bundle strains.

When certain athletes and professionals move their wrist in repetitive motion, or push and pull an object, they can experience tightness in the forearm and loose grip strength. Most people understand this as arm pump. However, arm pump isn't a blood flow issue, but a blood containment issue. Many different activities can cause arm pump. Twisting a throttle and pulling a clutch (motorcycle sports), climbing a rock formation (rock climbers), using a tool or surgical device (surgeons, dentists, carpenters, mechanics), pulling a hose (firemen and firewomen), controlling an opponent (MMA, BJJ, wrestling, grappling), as well as pushing weights (Olympic weight lifting).The energy required to perform these tasks attracts blood to the muscles in these compartments. When these muscles fill with blood, the fascia surrounding the muscles can restrict the temporary growth, causing a weaker grip. Fascia is a very stiff and constricting tissue.

The prior art has failed to provide a simple solution to enhancing grip strength and forearm health.

BRIEF SUMMARY OF THE INVENTION

The present invention provides a solution for the problem. The present invention is a self-therapy device that can expand and lengthen the tissue in the anterior and posterior compartments of the forearm. Anterior describes the inside or bottom of the forearm and posterior describes the top of the forearm. These compartments are compromised of fascia, muscles, nerves and arteries. Expanding the fascia and stretching the muscles in these compartments will allow for freer and less restrictive movement, which almost always results in greater grip strength. Users can generate more strength and relive elbow pain, as well as increasing grip and forearm endurance.

The device of the present invention allows a user to stretch and expand the fascia, allowing for blood to be increased in these muscles with less restriction. The device also effectively stretches the forearm muscles, which reduces their thickness, which will also decrease pressure. Using the device will allow a baseball pitcher or other overhead athlete to throw or serve with more velocity while decreasing the risk of an elbow or forearm flexor bundle injury. For golfers, the device allows the forearms to pronate and supinate more freely which creates better biomechanics throughout the swing an reduces the risk of golfer's elbow.

The contact point is tensioned into the forearm bundle while it is at its shortest point. When the client straightens their arm and then flexes their wrist, the forearm bundle moves past the tensioned contact point creating myofascial release of the forearm bundle, which frees up the grip. When the grip is freer, it takes less energy to twist a throttle and hold on to the grips, which in turn reduces the stress on the forearm bundle muscles, which reduces arm pump.

One aspect of the present invention is a device for enhancing grip strength and forearm health of a user. The device comprises a body in the form of a strap, a cuff disposed within a portion of the body, a tensioner comprising a rounded contact point and a threaded bolt. The tensioner is positioned through the cuff. The rounded contact point is configured to be driven into a forearm bundle of muscles of a user by turning the threaded bolt when an arm of the user is bent at the elbow.

Another aspect of the present invention is a method for enhancing grip strength and forearm health of a user. The method includes attaching a device to a forearm of a user that is bent at the elbowed. A cuff of the device surrounds a forearm of the user. The method also includes positioning a tensioner of the device over a forearm bundle of muscles. The method also includes turning a threaded bolt of the tensioner to drive a contact point of the tensioner into a forearm bundle of muscles of a user. The method also includes straightening an arm of the user and pulling a hand of the user forward to stretch the forearm bundle of muscles of the user pass the contact point.

Yet another aspect of the present invention is a method for performing myofascial release. The method includes attaching a device to a forearm of a user that is bent at the elbowed. A cuff of the device surrounds a forearm of the user. The method also includes positioning a tensioner of the device over a forearm bundle of muscles. The method also includes turning a threaded bolt of the tensioner to drive a contact point of the tensioner into a forearm bundle of muscles of a user. The method also includes performing myofascial release on the forearm of the user.

Yet another aspect of the present invention is a method for releasing forearm tension in a baseball player. The method includes attaching a device to a forearm of a user that is bent at the elbowed. A cuff of the device surrounds a forearm of the user. The method also includes positioning a tensioner of the device over a forearm bundle of muscles. The method also includes turning a threaded bolt of the tensioner to drive a contact point of the tensioner into a forearm bundle of muscles of a user. The method also includes performing myofascial release on the forearm of the user.

Yet another aspect of the present invention is a method for curing arm pump in a motocross racer. The method includes attaching a device to a forearm of a user that is bent at the elbowed. A cuff of the device surrounds a forearm of the user. The method also includes positioning a tensioner of the device over a forearm bundle of muscles. The method also includes turning a threaded bolt of the tensioner to drive a contact point of the tensioner into a forearm bundle of muscles of a user. The method also includes performing myofascial release on the forearm of the user.

Yet another aspect of the present invention is a method for treating tennis elbow. The method includes attaching a device to a forearm of a user that is bent at the elbowed. A cuff of the device surrounds a forearm of the user. The method also includes positioning a tensioner of the device over a forearm bundle of muscles. The method also includes turning a threaded bolt of the tensioner to drive a contact point of the tensioner into a forearm bundle of muscles of a user. The method also includes performing myofascial release on the forearm of the user.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
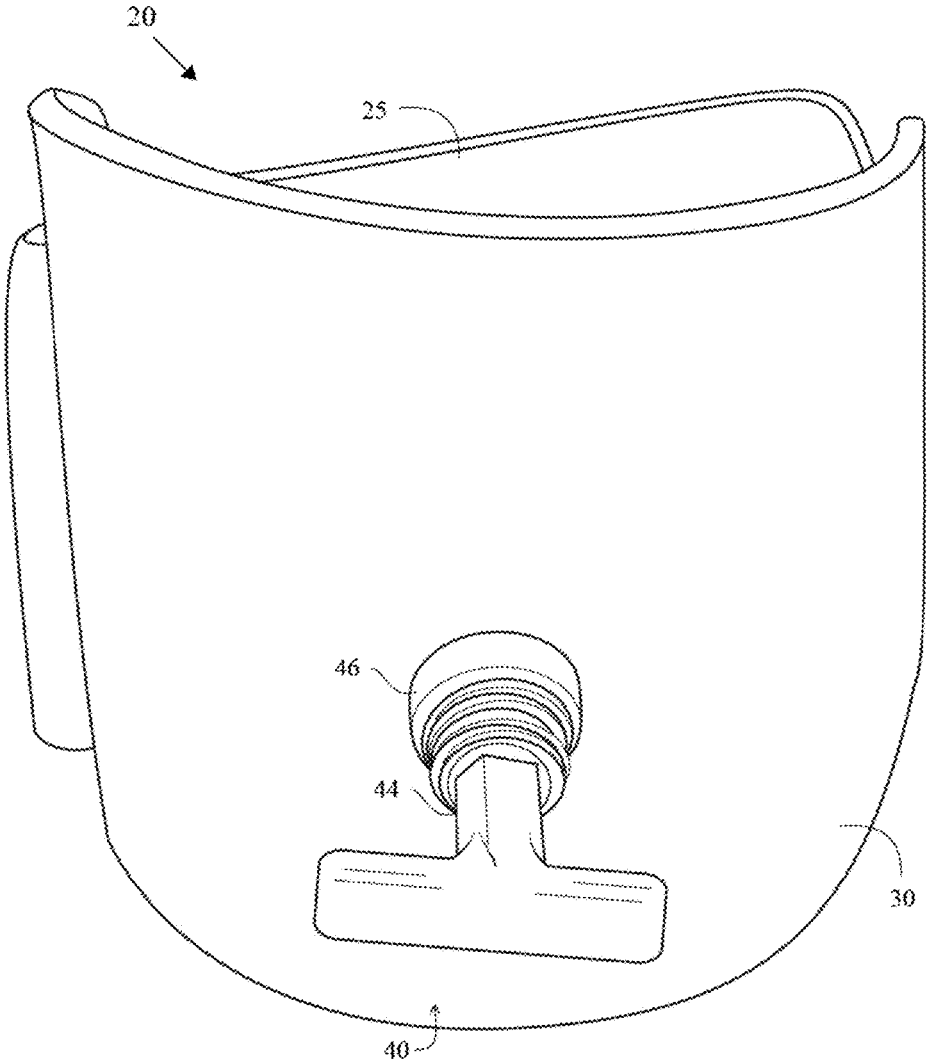
FIG. 1 is a front elevation view of a device for enhancing grip strength and forearm health of a user showing a tensioner.
Figure 2:
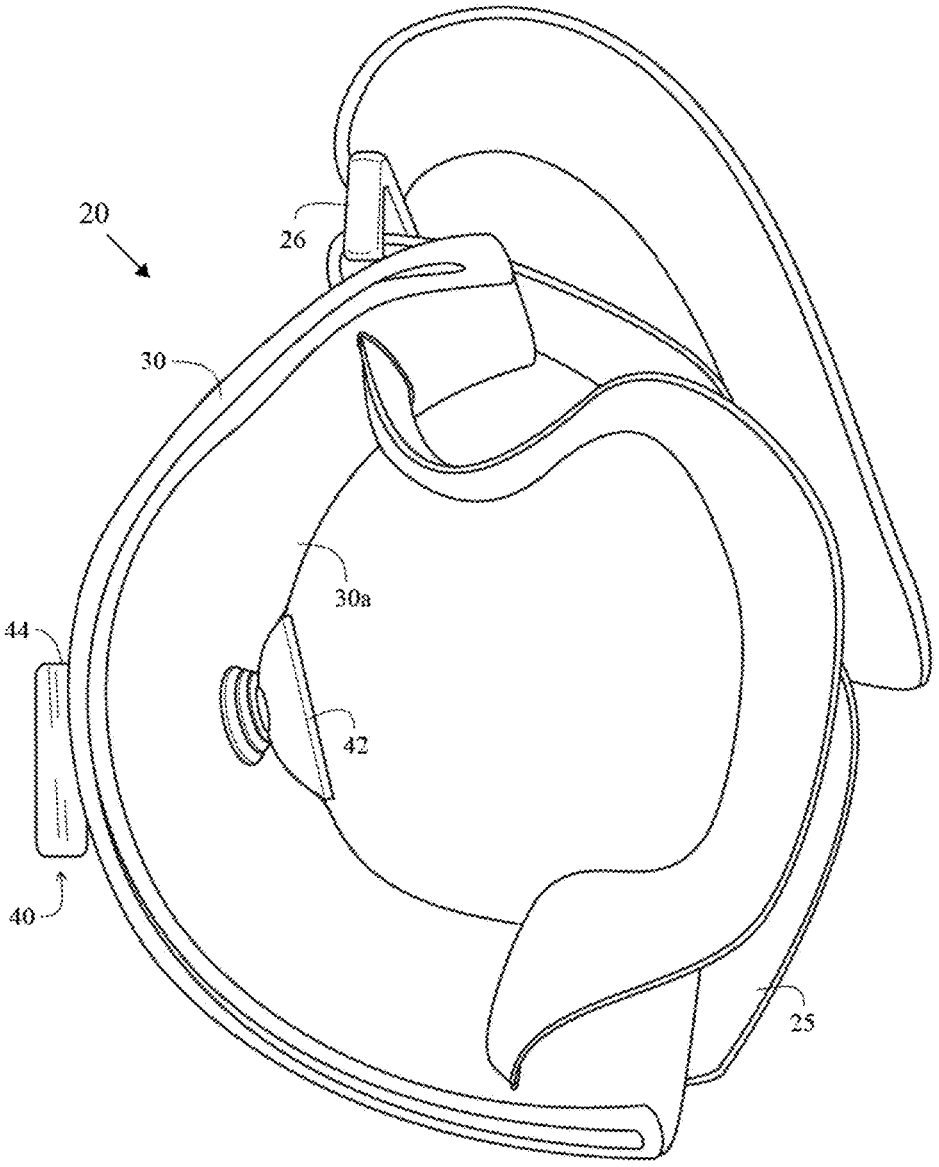
FIG. 2 is a top plan view of a device for enhancing grip strength and forearm health of a user showing a contact point and threaded bolt of a tensioner.
Figure 3:
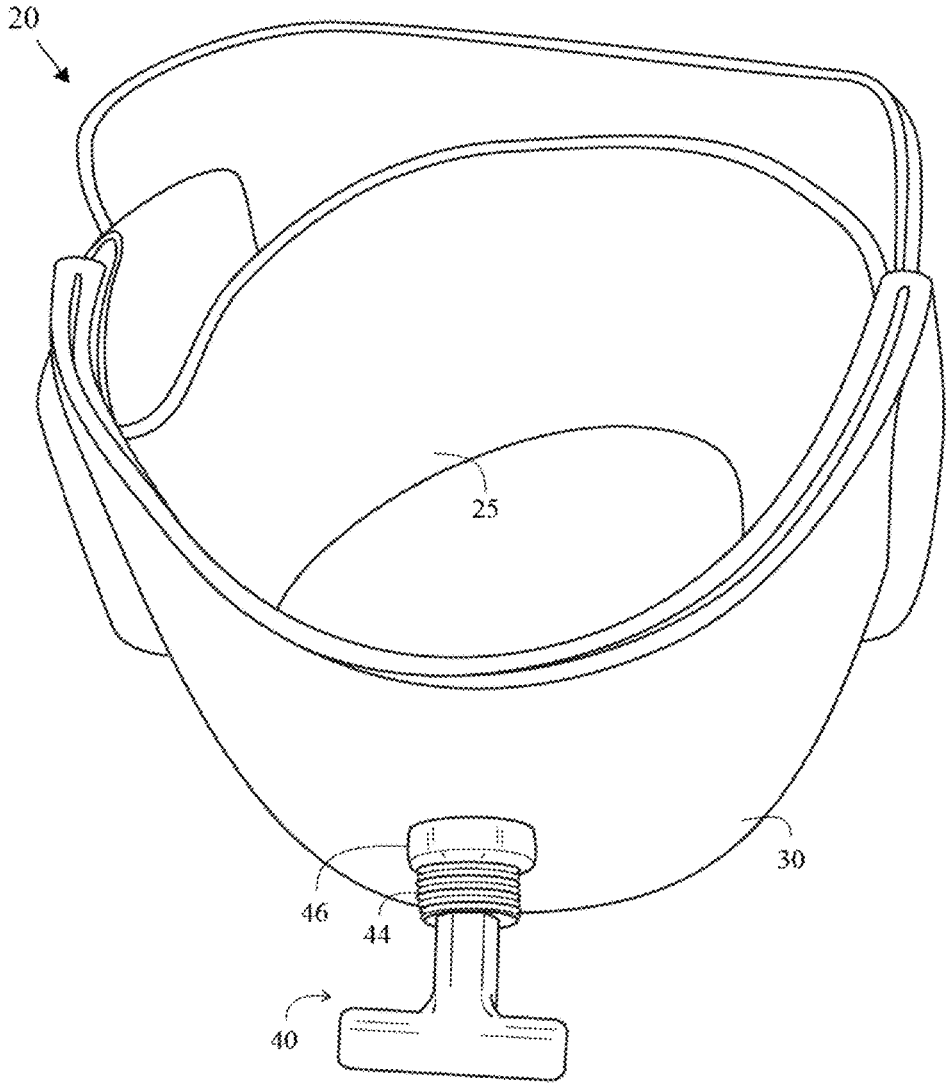
FIG. 3 is a top perspective view of a device for enhancing grip strength and forearm health of a user showing a contact point and threaded bolt of a tensioner.
Figure 4:
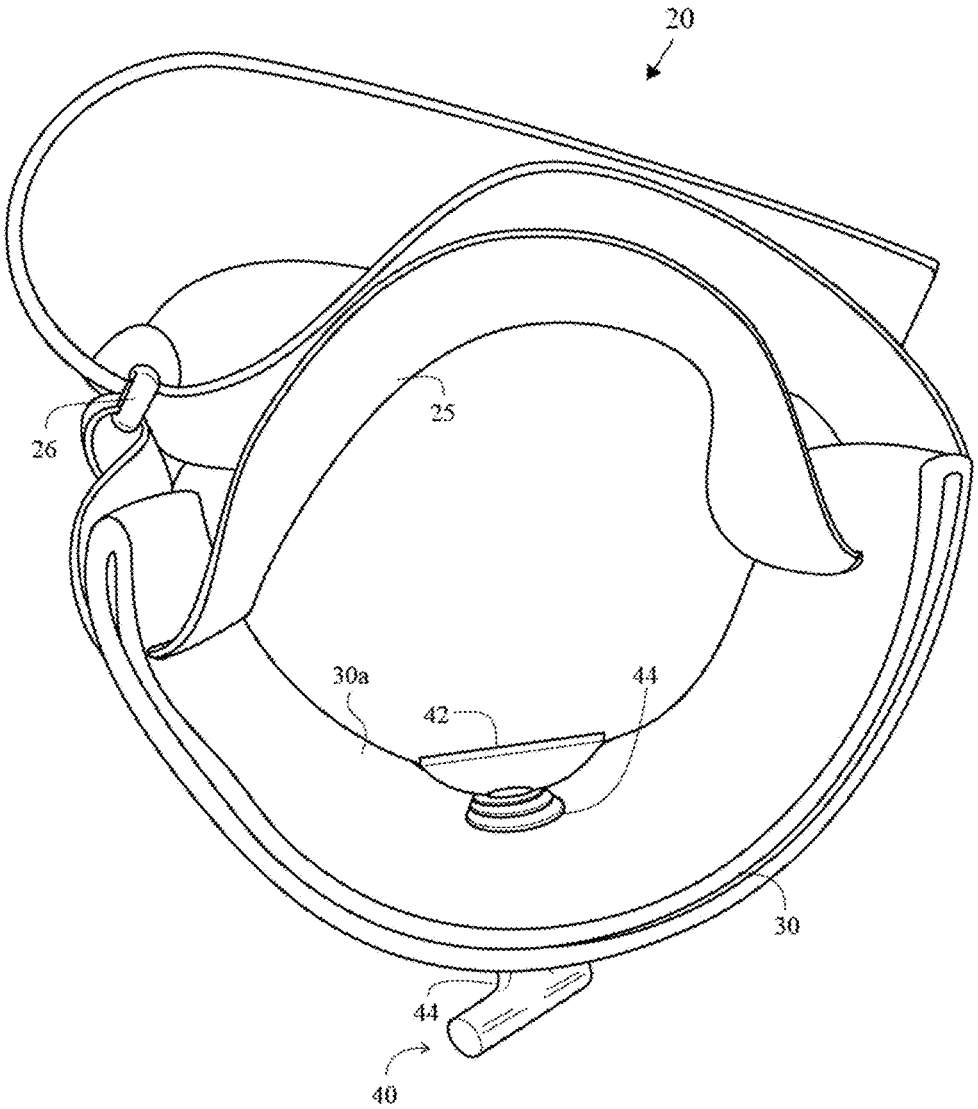
FIG. 4 is a bottom plan view of a device for enhancing grip strength and forearm health of a user showing a contact point and threaded bolt of a tensioner.

As shown in FIGS. 1-4, a device for enhancing grip strength and forearm health of a user is generally designated 20. The device 20 comprises a body 25 in the form of a strap, a cuff 30 disposed within a portion of the body 25, a tensioner 40 comprising a rounded contact point 42, a platform 46 and a threaded bolt (or knob) 44. The tensioner 40 is positioned through the cuff 30. The cuff 30 has an internal surface 30*a*. The rounded contact point 42 is configured to be driven into a forearm bundle of muscles of a user by turning the threaded bolt 44 when an arm of the user is bent at the elbow 110.

The cuff 30 is preferably composed of a metal material. The cuff 30 is preferably composed of an aluminum alloy material.

The user's arm is straightened and the user's hand is pulled forward to stretch the user's forearm bundle pass the contact point.

The body 25 further comprises a VELCRO hook and loop material to secure the body to the user's forearm.

The body 25 preferably has a width ranging from two inches to six inches, and a length preferably ranging from one foot to two feet.

The tensioner 40 is preferably composed of a metal material.

The tensioner 40 is preferably angled away from an elbow of the user.

Myofascial release is performed utilizing the device 20.

The body 25 is preferably composed of a fabric material.

Figure 9:
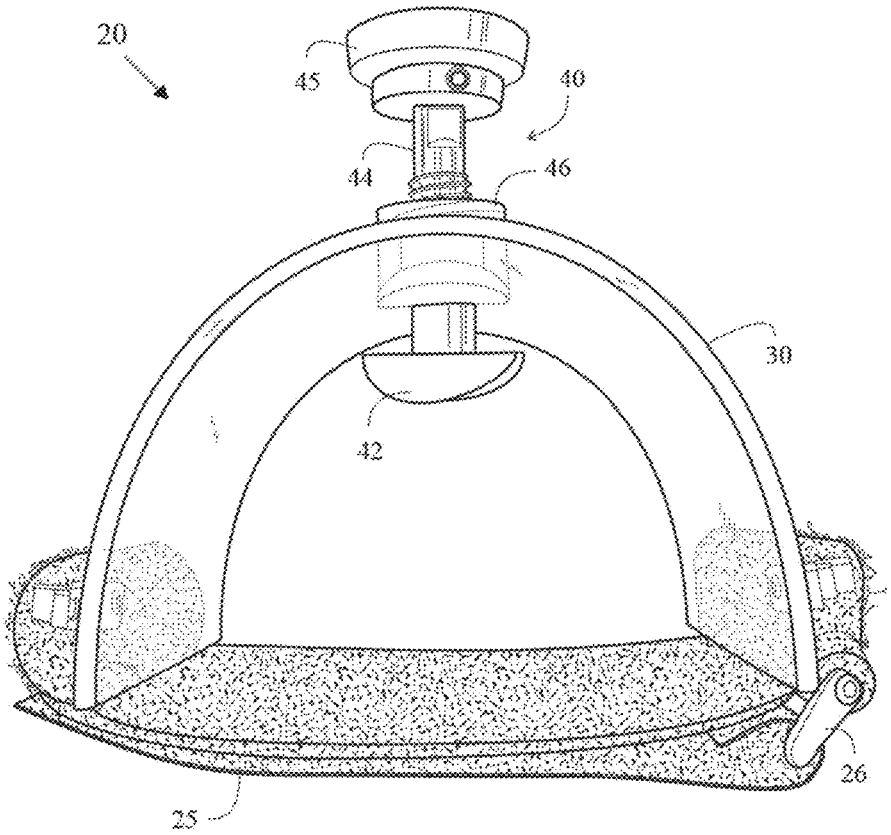
FIG. 9 is a top plan view of an alternative embodiment of a device for enhancing grip strength and forearm health of a user.
Figure 10:
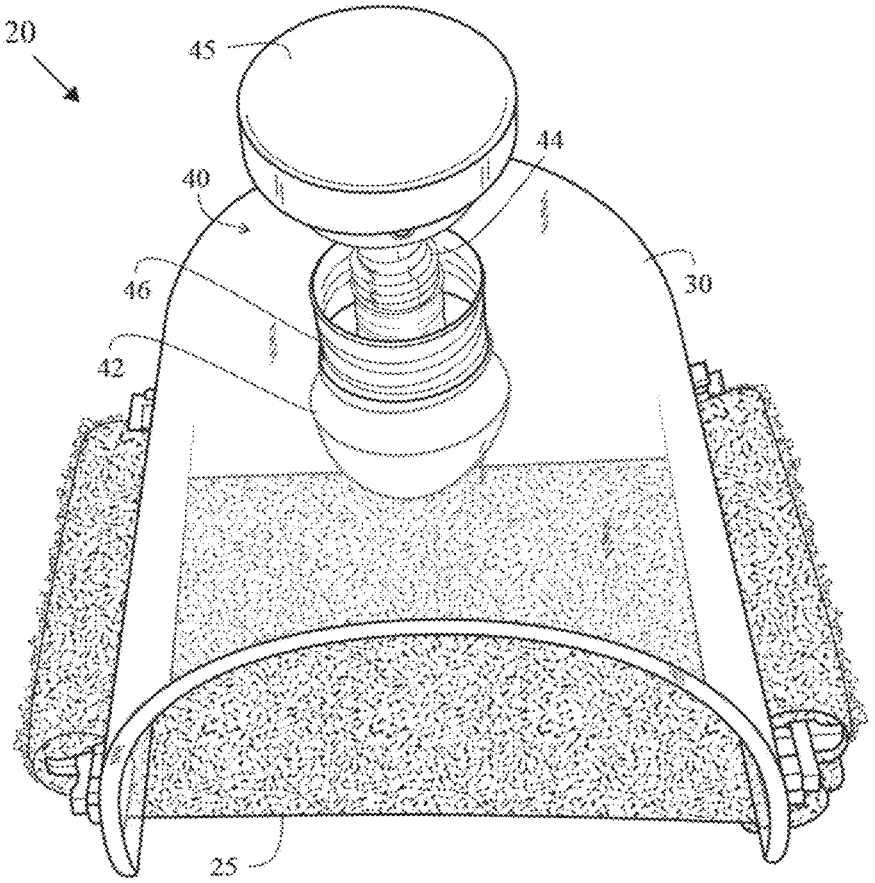
FIG. 10 is a top perspective view of an alternative embodiment of a device for enhancing grip strength and forearm health of a user.
Figure 11:
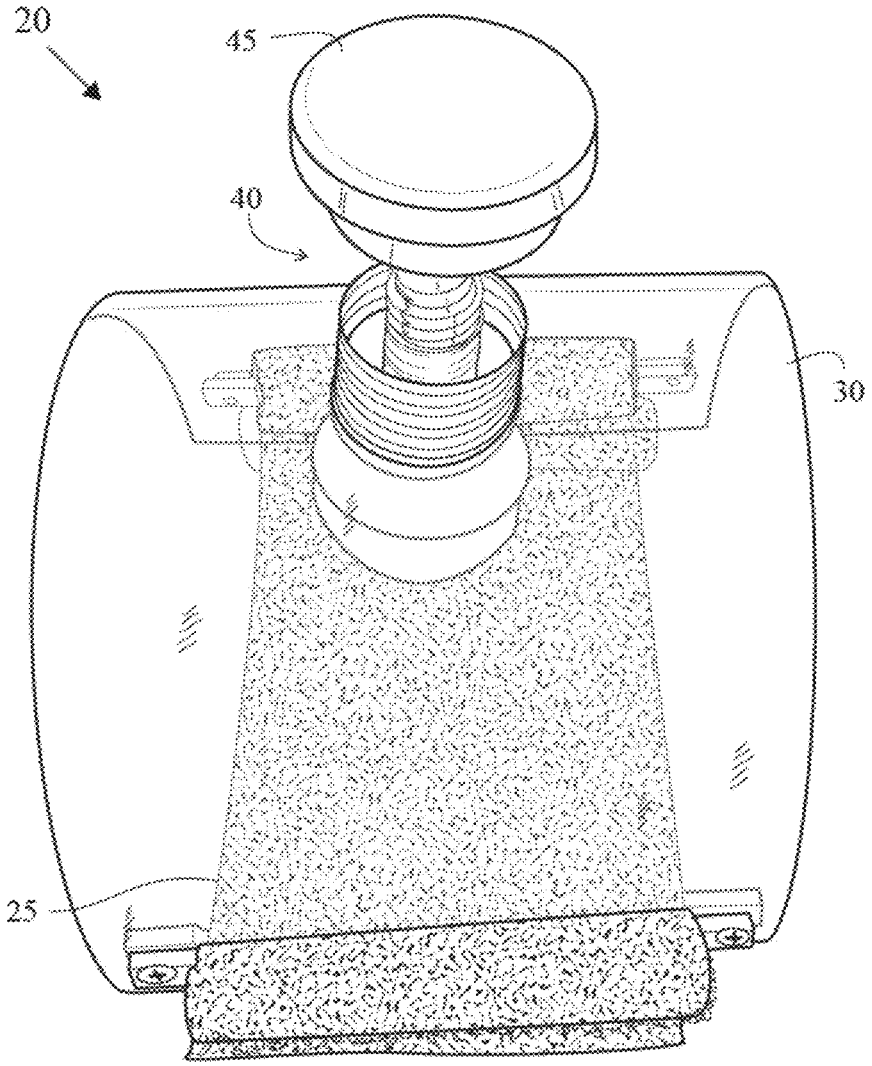
FIG. 11 is a front elevation view of an alternative embodiment of a device for enhancing grip strength and forearm health of a user.

An alternative embodiment of a device 20 for enhancing grip strength and forearm health of a user is shown in FIGS. 9-11. Isolated views of the components are shown in FIGS. 13-20. The device 20 comprises a body 25 in the form of a strap, a cuff 30 disposed within a portion of the body 25, a tensioner 40 comprising a rounded contact point 42, a threaded bolt 44 and a knob 45. The tensioner 40 is positioned through the cuff 30. The rounded contact point 42 is designed to be driven into a forearm bundle of muscles of a user by turning the threaded bolt 44 when an arm of the user is bent at the elbow.

In this embodiment, the cuff 30 is preferably composed of a transparent plastic material having a thicker center portion and a thinner edge portion. The edge portions preferably each have a thickness ranging from 0.050 inch to 1.25 inches, more preferably from 0.075 inch to 1.0 inch, and most preferably 0.09 inch. The center portion preferably has a thickness ranging from 1.0 inch to 1.5 inches, more preferably from 1.25 inches to 1.40 inches, and most preferably 1.35 inches. The cuff 30 preferably has a radius of curvature ranging from 2.0 inches to 3.0 inches, more preferably from 2.10 inches to 2.5 inches, and most preferably 2.20 inches. A platform 46 for the tensioner 40 preferably is angled four to fifteen degrees, more preferably six to ten degrees and most preferably at approximately eight degrees. The cuff 30 preferably has a width ranging from 3 inches to 5 inches, more preferably from 3.75 inches to 4.5 inches, and most preferably 4.125 inches. The cuff 30 preferably has a length ranging from 3.25 inches to 5.5 inches, more preferably from 4.0 inches to 5.0 inches, and most preferably 4.55 inches.

In this embodiment, the tensioner 40 preferably has a length ranging from 2.0 inches to 4.0 inches, more preferably from 2.5 inches to 3.0 inches, and most preferably 2.8 inches. The knob 45 preferably has a diameter ranging from 1.0 inch to 2.0 inches.

The strap is preferably tightened using a tightening mechanism 26.

Figure 5:
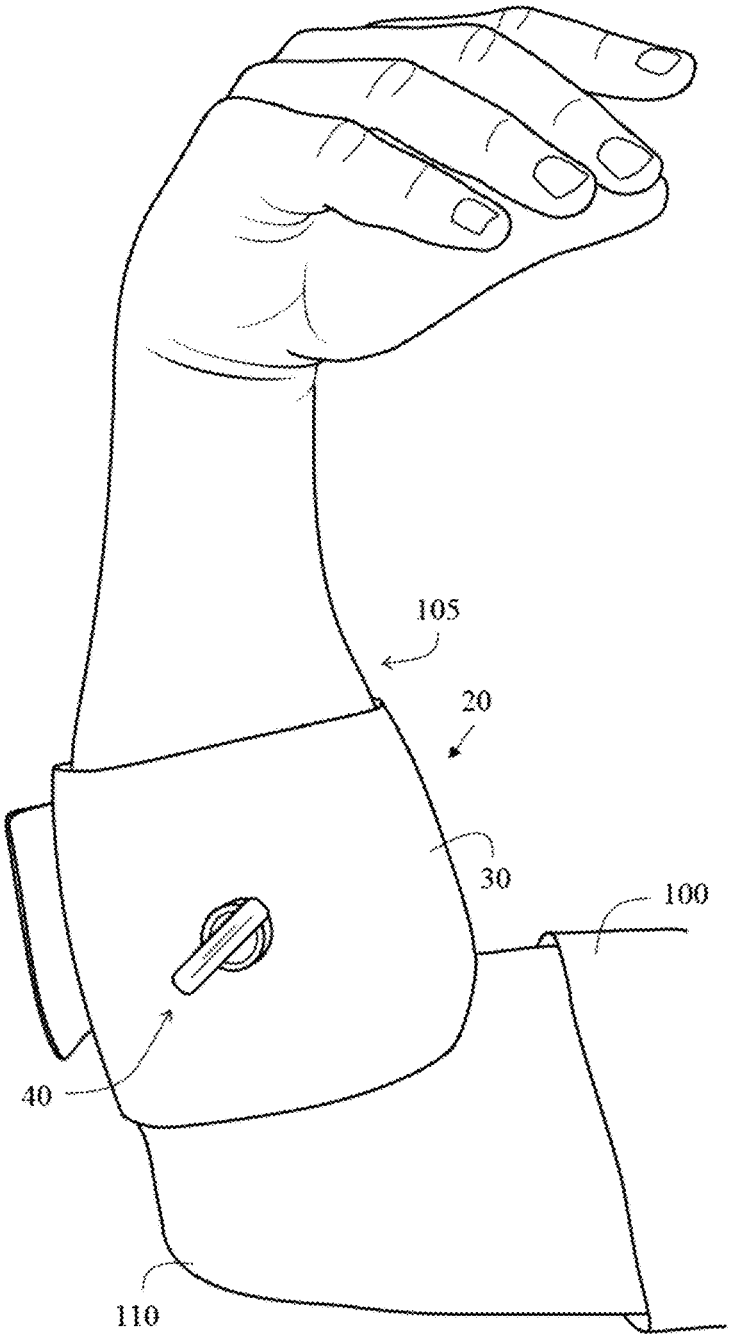
FIG. 5 is an illustration of a device for enhancing grip strength and forearm health attached to a forearm of a user with a contact point of a tensioner positioned over a forearm bundle of muscles.
Figure 8:
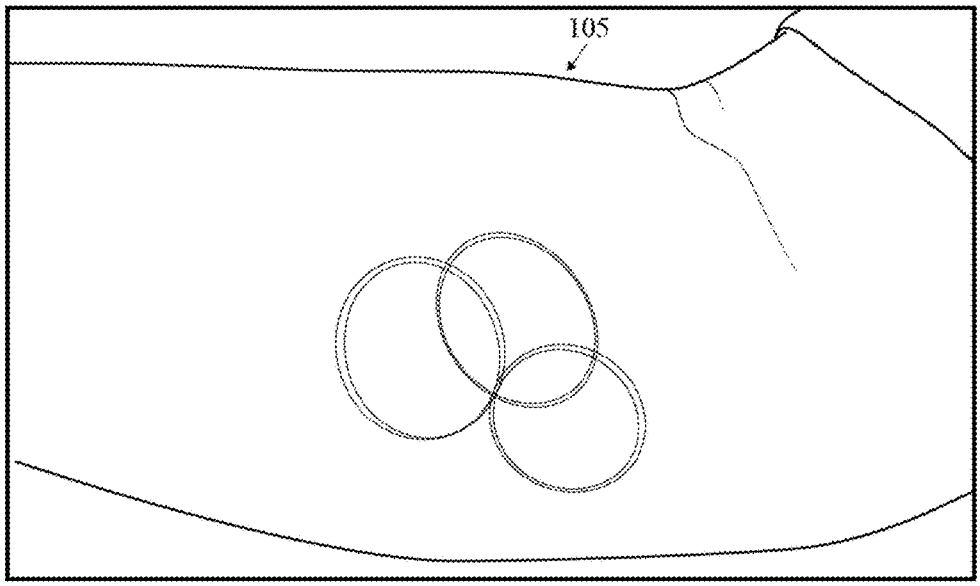
FIG. 8 is an illustration of a forearm of a user after myofascial release at three positions of the user's forearm using the device for enhancing grip strength and forearm health, wherein three intersecting circles are designed on the forearm of the user from the placement of the contact point of the tensioner at three different positions.
Figure 8A:
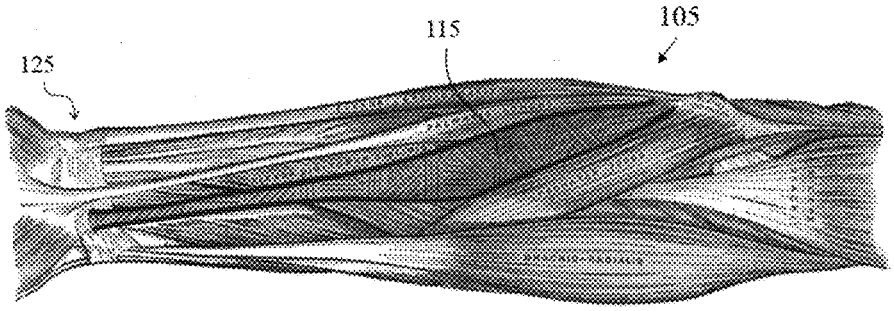
FIG. 8A is an illustration of muscles of a human arm.

As shown in FIG. 5, the device 20 for enhancing grip strength and forearm health attached to a forearm 105 of a user 100 with a contact point of a tensioner 40 positioned over a forearm bundle of muscles (as shown in FIG. 8A).

Figure 6:
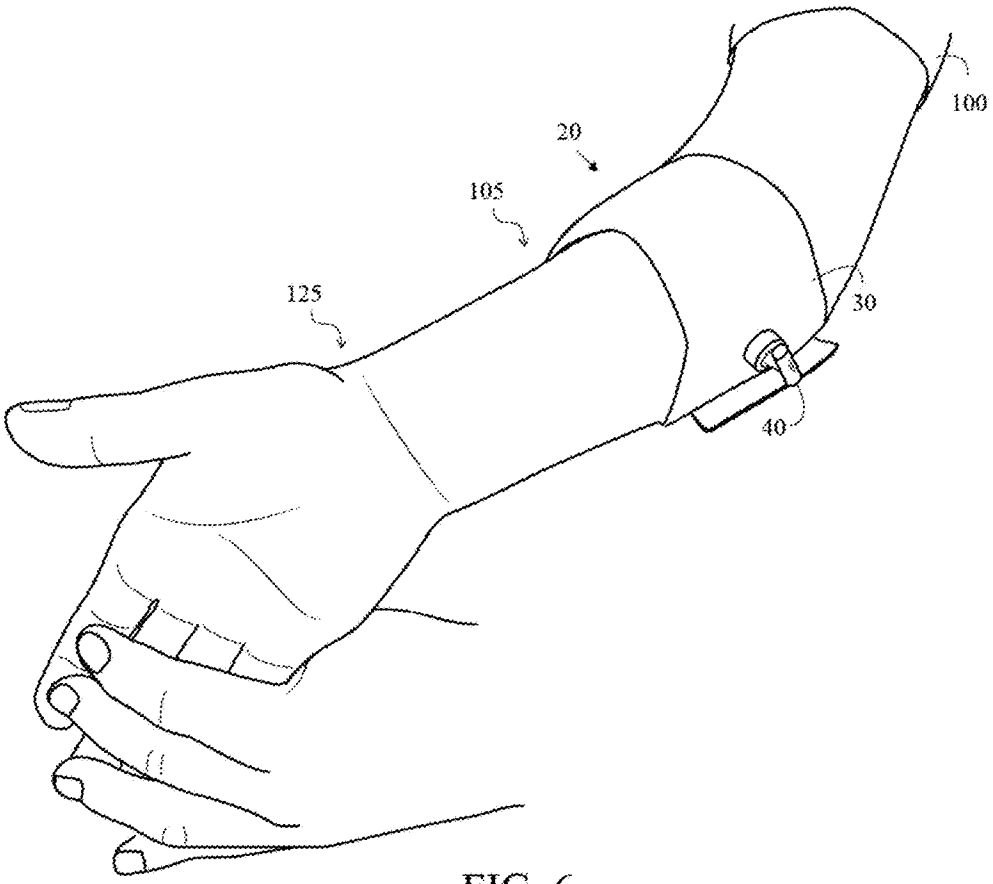
FIG. 6 is an illustration of a device for enhancing grip strength and forearm health attached to a forearm of a user and straightening the arm of the user and pulling the hand of the user forward to stretch the forearm bundle of muscles of the user pass the contact point.

As shown in FIG. 6 the arm of the user 100 is straightened and the hand 125 of the user 100 is pulled forward to stretch the forearm bundle of muscles of the user 100 pass the contact point 42.

Figure 7:
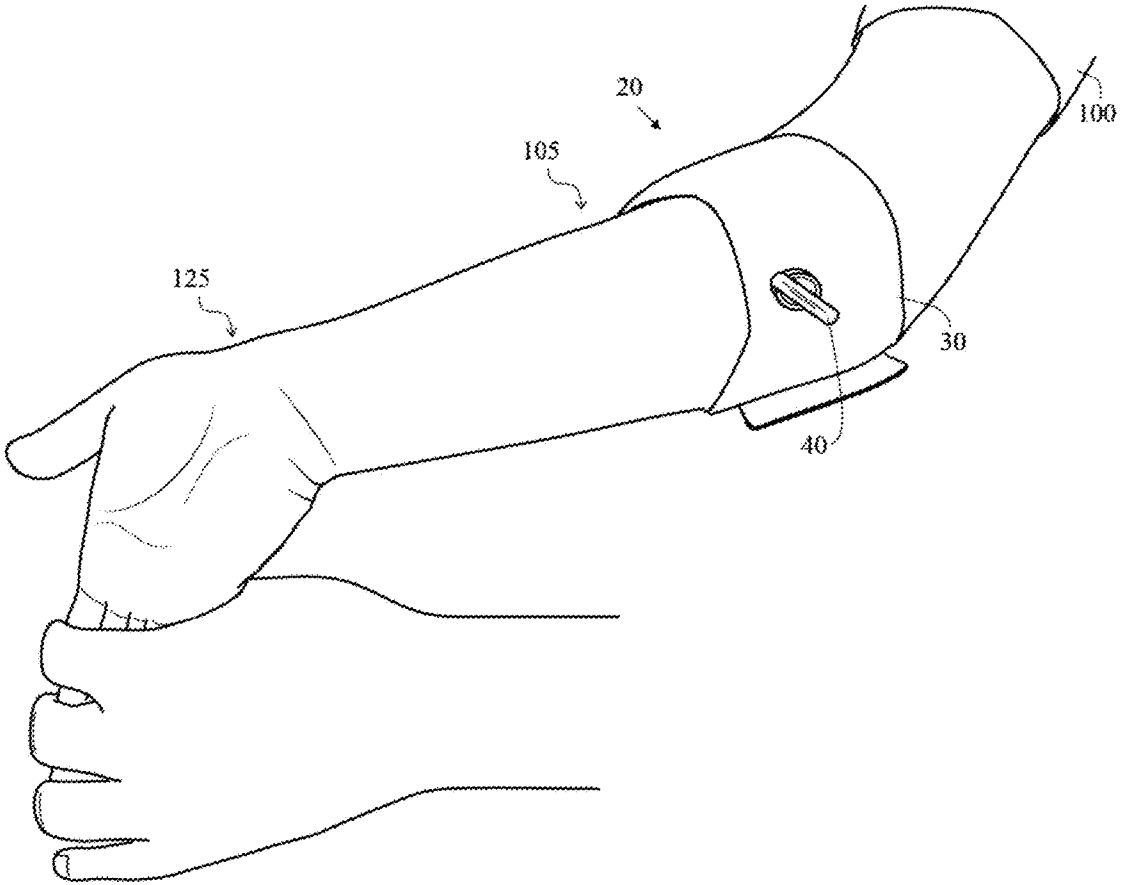
FIG. 7 is an illustration of a device for enhancing grip strength and forearm health attached to a forearm of a user and straightening the arm of the user and pulling the hand of the user forward to stretch the forearm bundle of muscles of the user pass the contact point.

As shown in FIG. 7, the arm of the user 100 is straightened further and 125 the hand of the user 100 is pulled forward even more to stretch the forearm bundle of muscles of the user 100 pass the contact point 42.

Figure 12:
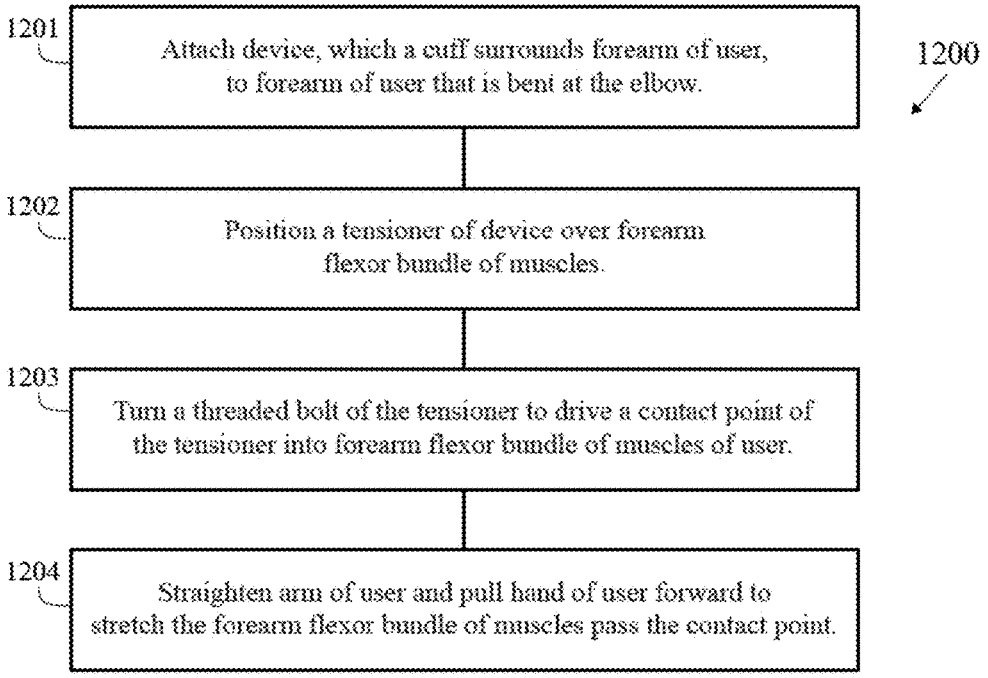
FIG. 12 is a flow chart of a method for enhancing grip strength and forearm health of a user.
Figure 13:
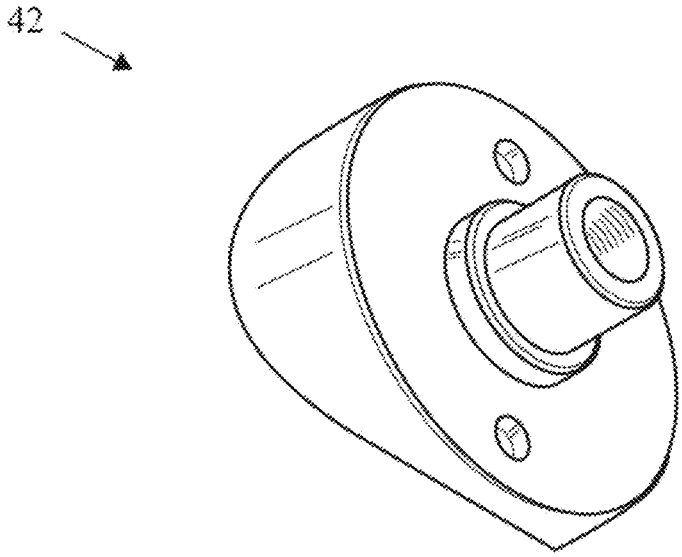
FIG. 13 is an isolated top perspective view of the contact point.
Figure 14:
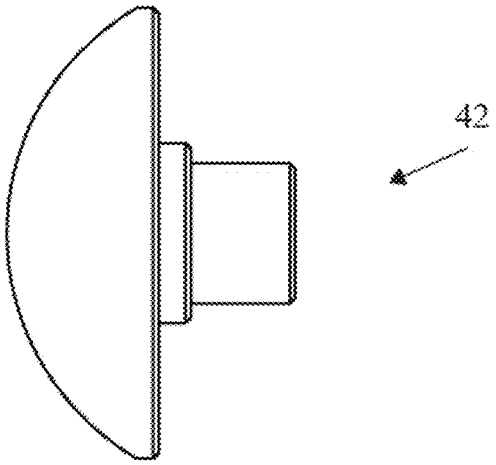
FIG. 14 is an isolated side elevation view of the contact point.
Figure 15:
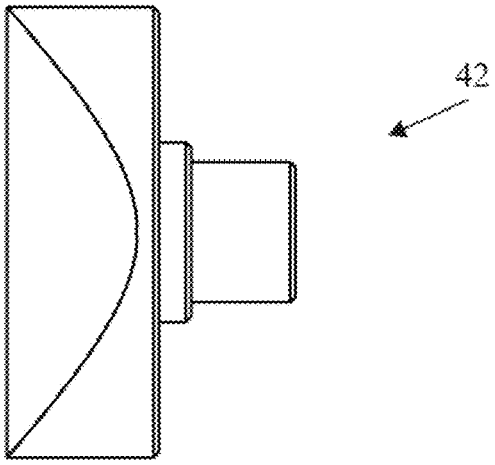
FIG. 15 is an isolated top plan view of the contact point.
Figure 16:
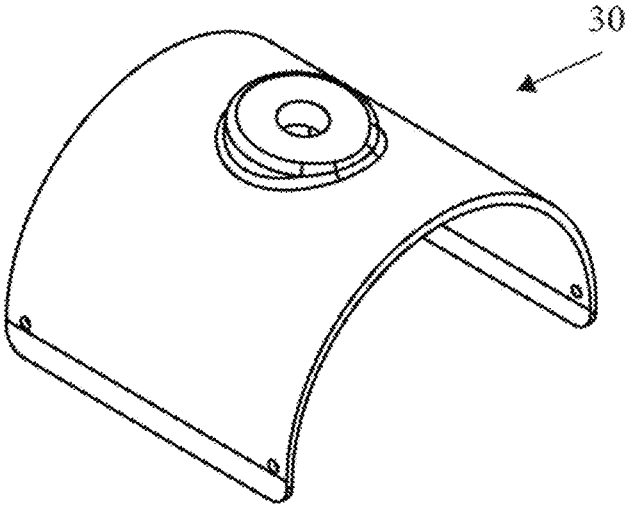
FIG. 16 is an isolated top perspective view of the cuff.
Figure 17:
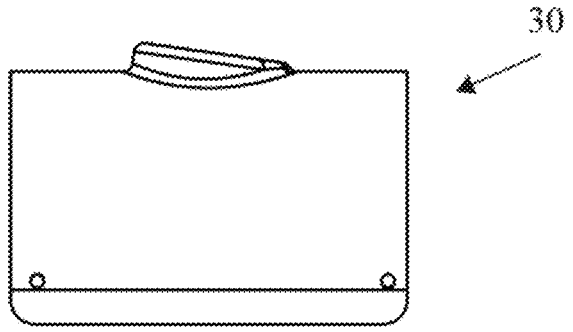
FIG. 17 is an isolated side elevation view of the cuff.
Figure 18:
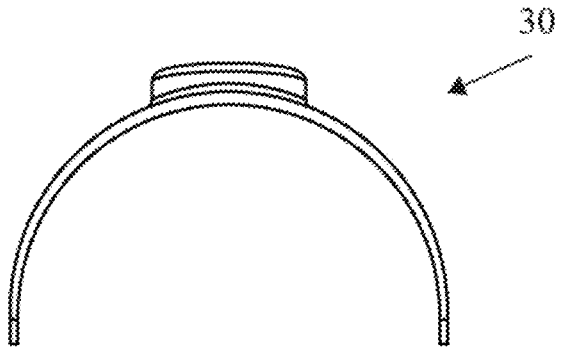
FIG. 18 is an isolated front elevation view of the cuff.
Figure 19:
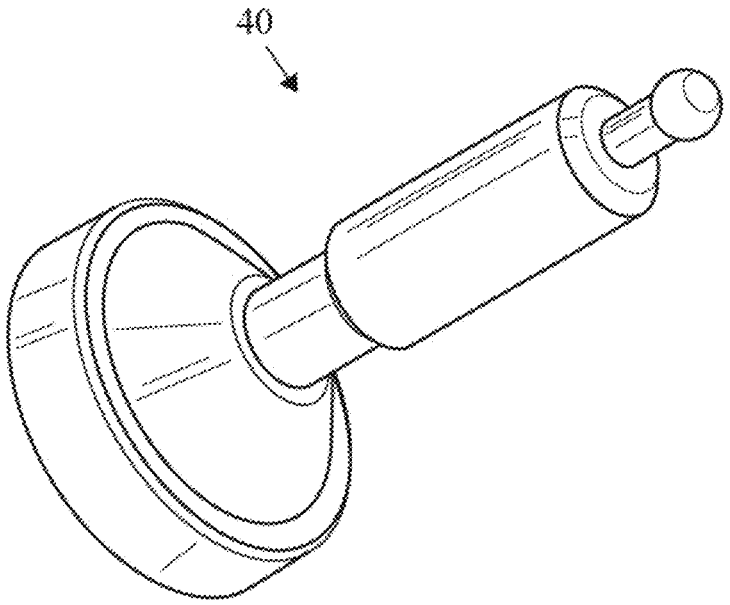
FIG. 19 is an isolated bottom perspective view of the tensioner.
Figure 20:
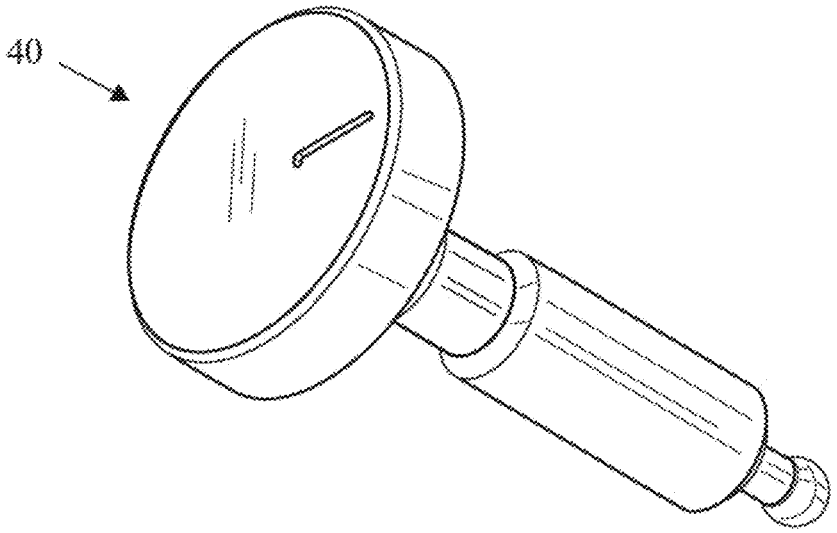
FIG. 20 is an isolated top perspective view of the tensioner.

A method 1200 for enhancing grip strength and forearm health of a user is shown in FIG. 12. At block 1201, a device is attached to a forearm of a user that is bent at the elbow 110. A cuff of the device surrounds a forearm of the user. At block 1202, a tensioner of the device is positioned over a forearm bundle of muscles. At block 1203, a threaded bolt of the tensioner is turned to drive a contact point of the tensioner into a forearm bundle of muscles of a user. At block 1204, an arm of the user is straightened and a hand of the user is pulled forward to stretch the forearm bundle of muscles of the user pass the contact point.

The method 1200 preferably further includes straightening the arm of the user and pulling the hand of the user forward to stretch the forearm bundle of muscles of the user pass the contact point at least two more cycles.

The method 1200 alternatively further includes straightening the arm of the user and pulling the hand of the user forward to stretch the forearm bundle of muscles of the user pass the contact point at least three more cycles.

The method 1200 further includes releasing tension from the contact point, and moving the contact point to a second position site on the forearm of the user. The method 1200 further includes turning the threaded bolt of the tensioner to drive the contact point of the tensioner into the second position site of the forearm bundle of muscles of the user. The method 1200 further includes straightening the arm of the user and pulling the hand of the user forward to stretch the forearm bundle of muscles of the user pass the contact point at the second position site.

The method 1200 alternatively further includes straightening the arm of the user and pulling the hand of the user forward to stretch the forearm bundle of muscles of the user pass the contact point at the second position site for at least two more cycles.

The method 1200 alternatively further includes straightening the arm of the user and pulling the hand of the user forward to stretch the forearm bundle of muscles of the user pass the contact point at the second position site for at least three more cycles.

The method 1200 further includes releasing tension from the contact point, and moving the contact point to a third position site on the forearm of the user. The method 1200 also includes turning the threaded bolt of the tensioner to drive the contact point of the tensioner into the third position site of the forearm bundle of muscles of the user. The method 1200 also includes straightening the arm of the user and pulling the hand of the user forward to stretch the forearm bundle of muscles of the user pass the contact point at the third position site.

The method 1200 alternatively includes straightening the arm of the user and pulling the hand of the user forward to stretch the forearm bundle of muscles of the user pass the contact point at the third position site for at least two more cycles.

The method 1200 alternatively includes straightening the arm of the user and pulling the hand of the user forward to stretch the forearm bundle of muscles 115 (as shown in FIG. 8A) of the user pass the contact point at the third position site for at least three more cycles.

As shown in FIG. 8, the contact point 42 preferably forms an interconnected three circle design on the forearm 105 of the user.

The user's arm is preferably straightened and the user's hand is pulled forward to stretch the user's forearm bundle pass the contact point.

A specific embodiment of the invention is a method for performing myofascial release. The method includes attaching a device to a forearm of a user that is bent at the elbowed. A cuff of the device surrounds a forearm of the user. The method also includes positioning a tensioner of the device over a forearm bundle of muscles. The method also includes turning a threaded bolt of the tensioner to drive a contact point of the tensioner into a forearm bundle of muscles of a user. The method also includes performing myofascial release on the forearm of the user.

Another specific embodiment a method for releasing forearm tension in a baseball player. The method includes attaching a device to a forearm of a user that is bent at the elbowed. A cuff of the device surrounds a forearm of the user. The method also includes positioning a tensioner of the device over a forearm bundle of muscles. The method also includes turning a threaded bolt of the tensioner to drive a contact point of the tensioner into a forearm bundle of muscles of a user. The method also includes performing myofascial release on the forearm of the user.

Yet another specific embodiment of the invention is a method for curing arm pump in a motocross racer. The method includes attaching a device to a forearm of a user that is bent at the elbowed. A cuff of the device surrounds a forearm of the user. The method also includes positioning a tensioner of the device over a forearm bundle of muscles. The method also includes turning a threaded bolt of the tensioner to drive a contact point of the tensioner into a forearm bundle of muscles of a user. The method also includes performing myofascial release on the forearm of the user.

Yet another specific embodiment of the invention is a method for treating tennis elbow. The method includes attaching a device to a forearm of a user that is bent at the elbowed. A cuff of the device surrounds a forearm of the user. The method also includes positioning a tensioner of the device over a forearm bundle of muscles. The method also includes turning a threaded bolt of the tensioner to drive a contact point of the tensioner into a forearm bundle of muscles of a user. The method also includes performing myofascial release on the forearm of the user.

One example of using the device 20 is set forth in the following steps. Step One: A user slides the device 20 with the knob 45 angle away from the elbow. The tension contact point 42 should be contacting the skin over the forearm flexor bundle muscles on the exact side of the forearm. The user tightens the strap so that the cuff 30 is snug around the user's forearm. Preferably, red arrows around the contact point 42 should be pointing horizontally on the forearm.

Step Two: Next, the arm of the user is bent up, the wrist is relaxed and the hand is flexed to a 90 degree angle. This puts the flexor muscles in the shortest position possible. The forearm muscles should be relaxed.

Step Three: With the flexor muscles loose, relaxed and shortened, the user turns the tension knob 45 three or four turns to tension the contact point 42 against the muscles.

Step Four: The user completely straightens the arm, but keeps the wrist flexed. Once the arm is completely straight, the user extends the wrist by taking the other hand and pulling backwards (into full extension). When the user fully extends the wrist, the user will feel the forearm muscles pass by the tensioned contact. The user holds the stretch for 15 to 20 seconds. The user bends the user's arm again, and then one more time, and hold for another 15 to 20 seconds. Another repetition is optional.

Step Five: The user should feel a good amount of pressure, however, if it is too uncomfortable or if the user feels a burning sensation, the user should loosen the knob 45 ½ turn until the movement is tolerable. If the user does not feel a good amount of pressure, the user should tighten the knob 45 until it feels good.

Step Six: The user should loosen the contact point 42 and strap 25 completely, and slide the cuff 30 up the arm toward the wrist approximately ½ inch and up towards the middle of the forearm ½ inch and repeat. The user then loosens the contact point 42 completely once again, and slides the cuff 30 back to the side of the forearm and up another ½ inch toward the wrist and repeat. The total amount of stretches will be two to three stretches in three different spots. The user can also test more than three spots in this format. When the user removes the device, the user should see an impression pattern as shown in FIG. 8.

Step Seven: To stretch the top of the forearm, the user should loosen the contact point 42 and strap 25, and rotate over the top of the forearm extensor muscle. These muscles begin close to the elbow and run straight down the top of the forearm. The user should start on the most prominent muscle on the top of the forearm.

Step Eight: With the forearm slightly bent and the wrist totally extended (hand pointing up), the user should turn the tension knob 45 two turns or until the user feels the same type of pressure as on the flexor side.

Step Nine: The user should straighten the arm and completely flex the wrist, holding the stretch for 15 to 20 seconds. This should be repeated one time.

Step Ten: The user should loosen the contact point 42 and strap 25, and slide the cuff 30 down the muscle toward the wrist ½ inch and repeat.

The treatment for tennis elbow includes moving the contact point 42 to the top of the forearm and placing the contact in front of the lateral epicondyle. The contact point 42 is then tensioned down, with a fully extended hand. Then, the user fully flexes the hand, stretching the forearm extensor muscles passed the tensioned contact point 42.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

I claim as my invention the following:

1. A device for enhancing muscle health of a user, the device comprising:

a body in the form of a strap;

a cuff disposed within a portion of the body, the cuff composed of a transparent plastic material, the cuff having a center portion thicker than a plurality of edge portions, and the center portion having a thickness within the range of 1.0 inch to 1.5 inches, the cuff having a radius of curvature within the range of 2.0 inches to 3.0 inches, the cuff having a width within the range of 3 inches to 5 inches;

a tensioner extending from the cuff, the tensioner having a length within the range of 2 inches to 4 inches, the tensioner comprising a rounded contact point, a platform and a threaded bolt, the tensioner positioned through the cuff, the tensioner is composed of a metal material, the platform is angled four to fifteen degrees relative to a surface of the cuff;

wherein the device is configured to be worn on a forearm of the user;

wherein the rounded contact point is configured to be driven into a bundle of muscles of the user by turning the threaded bolt when the device is on the user;

wherein the device is configured to perform myofascial release.

* * * * *